US009456731B2

(12) United States Patent
Berends et al.

(10) Patent No.: US 9,456,731 B2
(45) Date of Patent: Oct. 4, 2016

(54) DISHWASHER HAVING A TURBIDITY SENSOR

(75) Inventors: Erik Berends, Bielefeld (DE); Guenther Ennen, Enger (DE); Seyfettin Kara, Spenge (DE)

(73) Assignee: MIELE & CIE. KG, Guetersloh (DE)

( * ) Notice: Subject to any disclaimer, the term of this patent is extended or adjusted under 35 U.S.C. 154(b) by 880 days.

(21) Appl. No.: 12/740,135

(22) PCT Filed: Oct. 29, 2008

(86) PCT No.: PCT/EP2008/009103

§ 371 (c)(1), (2), (4) Date: Aug. 6, 2010

(87) PCT Pub. No.: WO2009/056278

PCT Pub. Date: May 7, 2009

(65) Prior Publication Data

US 2010/0295690 A1 Nov. 25, 2010

(30) Foreign Application Priority Data

Oct. 31, 2007 (DE) ..... 10 2007 052 332

(51) Int. Cl.

| | |
|---|---|
| ***G08B 21/00*** | (2006.01) |
| ***G08B 3/00*** | (2006.01) |
| ***B08B 7/04*** | (2006.01) |
| ***B08B 3/00*** | (2006.01) |
| ***A47L 15/42*** | (2006.01) |
| ***A47L 15/00*** | (2006.01) |

(52) U.S. Cl.

CPC ..... *A47L 15/4293* (2013.01); *A47L 15/0049* (2013.01); *A47L 2301/00* (2013.01); *A47L 2401/10* (2013.01); *A47L 2501/26* (2013.01); *A47L 2501/30* (2013.01)

(58) Field of Classification Search

CPC ..... B01D 61/12; A61F 13/42; G08B 7/066; G01N 21/53; B08B 3/02; B08B 3/00

USPC ..... 340/603, 604, 691.1; 134/18, 113

See application file for complete search history.

(56) References Cited

U.S. PATENT DOCUMENTS 4,628,443 A * 12/1986 Rickard et al. ..... 700/79
5,285,375 A * 2/1994 Kim ..... 700/1
5,297,307 A * 3/1994 Baek ..... D06F 3/02 68/12.02

(Continued)

FOREIGN PATENT DOCUMENTS

DE 2824973 A1 12/1979
DE 19745428 A1 5/1998

(Continued)

OTHER PUBLICATIONS

International Search Report for PCT/EP2008/009103 mailed on Jan. 28, 2009.

*Primary Examiner* — George Bugg
*Assistant Examiner* — Munear Akki
(74) *Attorney, Agent, or Firm* — Leydig, Voit & Mayer, Ltd.

(57) ABSTRACT

A dishwasher includes an input element configured to select a first wash cycle from a plurality of wash cycles, a controller configured to control a cycle parameter, a turbidity sensor configured to measure a soil level of a wash liquid, and a display device configured to at least temporarily display the soil level measured by the turbidity sensor.

6 Claims, 2 Drawing Sheets

(56) References Cited

U.S. PATENT DOCUMENTS 5,438,507 A * 8/1995 Kim et al. ..... 700/1
5,555,583 A * 9/1996 Berkcan ..... 8/158
5,560,060 A * 10/1996 Dausch et al. ..... 8/158
5,800,628 A 9/1998 Erickson et al.
5,803,985 A * 9/1998 Alvord ..... 134/18
5,960,804 A * 10/1999 Cooper ..... A47L 15/0021 134/56 D
6,182,674 B1 * 2/2001 Jozwiak et al. ..... 134/56 R
6,752,875 B2 * 6/2004 Kiesler et al. ..... 134/18
6,811,617 B2 * 11/2004 Elick et al. ..... 134/10
7,114,209 B2 * 10/2006 Metzger-Groom ..... D06F 9/004 68/12.12
7,146,991 B2 * 12/2006 Stockert ..... 134/57 R
7,195,023 B2 * 3/2007 McKee et al. ..... 134/57 D
7,241,347 B2 * 7/2007 Elick et al. ..... 134/18
7,246,395 B2 * 7/2007 Buckroyd et al. ..... 8/158
7,246,625 B2 7/2007 Ekelhoff
7,434,424 B2 * 10/2008 Lueckenbach et al. ..... 68/12.02
7,789,968 B2 * 9/2010 Elick et al. ..... 134/18
8,157,920 B2 * 4/2012 Bragg ..... 134/18
2006/0042658 A1 * 3/2006 Engler ..... A47L 15/4297 134/18
2007/0246069 A1 * 10/2007 Elick ..... A47L 15/44 134/18
2008/0276965 A1 * 11/2008 Aykroyd ..... D06F 3/02 134/18
2008/0314423 A1 * 12/2008 Berends et al. ..... 134/57 D
2009/0000644 A1 * 1/2009 Druecker et al. ..... 134/18
2009/0056754 A1 * 3/2009 Rolek ..... 134/18
2012/0011662 A1 * 1/2012 Yusuf et al. ..... 8/137

FOREIGN PATENT DOCUMENTS

DE 10057210 A1 5/2002
DE 10059112 C1 5/2002
DE 101 56 924 A1 6/2003
DE 69627912 T2 5/2004
DE 102005005039 A1 8/2006
EP 0725181 B1 5/2003
GB 2 022 872 A 12/1979
WO WO 2006087735 A1 * 8/2006 ..... A47L 15/4293

* cited by examiner

DISHWASHER HAVING A TURBIDITY SENSOR

CROSS-REFERENCE TO PRIOR APPLICATIONS

This applications is a U.S. National Phase application under 35 U.S.C. §371 of International Application No. PCT/EP2008/009103, filed on Oct. 29, 2008 and claims benefit to German Patent Application No. DE 10 2007 052 332.9, filed on Oct. 31, 2007. The International Application was published in German on May 7, 2009 as WO 2009/056278 A1 under PCT Article 21(2).

FIELD

The present invention relates in general to a dishwasher and in particular to a dishwasher including a user control and display unit having input elements for the selection of a wash cycle from a plurality of possible wash cycles, at least one display means, means for controlling cycle parameters, such as the duration and temperature profile of individual sub-cycles, and further having a turbidity sensor capable of measuring the soil level of a wash liquid.

BACKGROUND

German Patent DE 100 59 112 C1, which is hereby incorporated by reference herein, describes a dishwasher having a turbidity sensor provided in a wash-water circuit to measure the soil level of the wash liquid. Automatic wash cycles can then be performed as selected or modified according to the detected signals, for example, to add additional intermediate rinse cycles, thus making it possible to optimize the dishwashing sequence. The choice of wash cycles also includes fixedly predetermined, standard wash cycles, during which the values measured by the turbidity sensor are not evaluated. A dishwasher of this type is problematic in that it does not provide the user with any feedback that would allow him or her to make a better choice the next time he or she selects a wash cycle. If the user constantly chooses a wash cycle that is inadequate for the existing soil load, resources may be unnecessarily wasted.

SUMMARY

In an embodiment, the present invention provides a dishwasher, including an input element configured to select a first wash cycle from a plurality of wash cycles, a controller configured to control a cycle parameter, a turbidity sensor configured to measure a soil level of a wash liquid, and a display device configured to at least temporarily display the soil level measured by the turbidity sensor.

DETAILED DESCRIPTION

In one embodiment, the present invention provides a dishwasher that offers a high degree of ease of operation.

In one embodiment, the soil level detected by the turbidity sensor is displayed, at least temporarily, on the display means, so that the user is provided with feedback on whether the wash cycle selected was appropriate for the soil level actually present. The user is thereby enabled to select an optimum dishwashing sequence, and is easily guided through the process of entering control information.

In accordance with a further embodiment, the soil level is displayed directly in several gradations. In this manner, the user can be provided with feedback on how the soil level is assessed by the controller of the dishwasher. The user can then select the desired wash cycle himself or herself, at least the next time he or she turns on the dishwasher. Alternatively, the soil level may also be displayed in the form of information on the selection of a suitable wash cycle, since it is desired that a suitable wash cycle is selected, and that the user then has to deal only indirectly with the soil load of the dishes. Advantageously, the detected soil level can be used to automatically select the wash cycle, and the selected wash cycle, and the selected wash cycle is then displayed.

In accordance with another embodiment, a soil level can be selected using the input elements, and a comparison can be made by the controller as to whether the actual soil level substantially corresponds to the soil level selected by the user. If the actual soil level differs from the soil level that has been selected, correction information may be output, providing instructions to the user. Alternatively, such correction information may be displayed only after a deviation between the actual soil level and the selected soil level has been detected several times, so that corresponding instructions are issued to the user only after he or she has repeatedly made incorrect selections.

If the actual soil level differs from the soil level that has been selected, at least one sub-cycle of a wash cycle may be automatically modified by the controller independently of the display of information. Such modification may be, for example, to add an additional rinse cycle to deal with coarse soils more effectively. It is also possible to vary other parameters, such as temperature and duration of the dishwashing sequence.

The present invention will be explained in more detail below with reference to an exemplary embodiment and the accompanying drawings.

Figure 1:
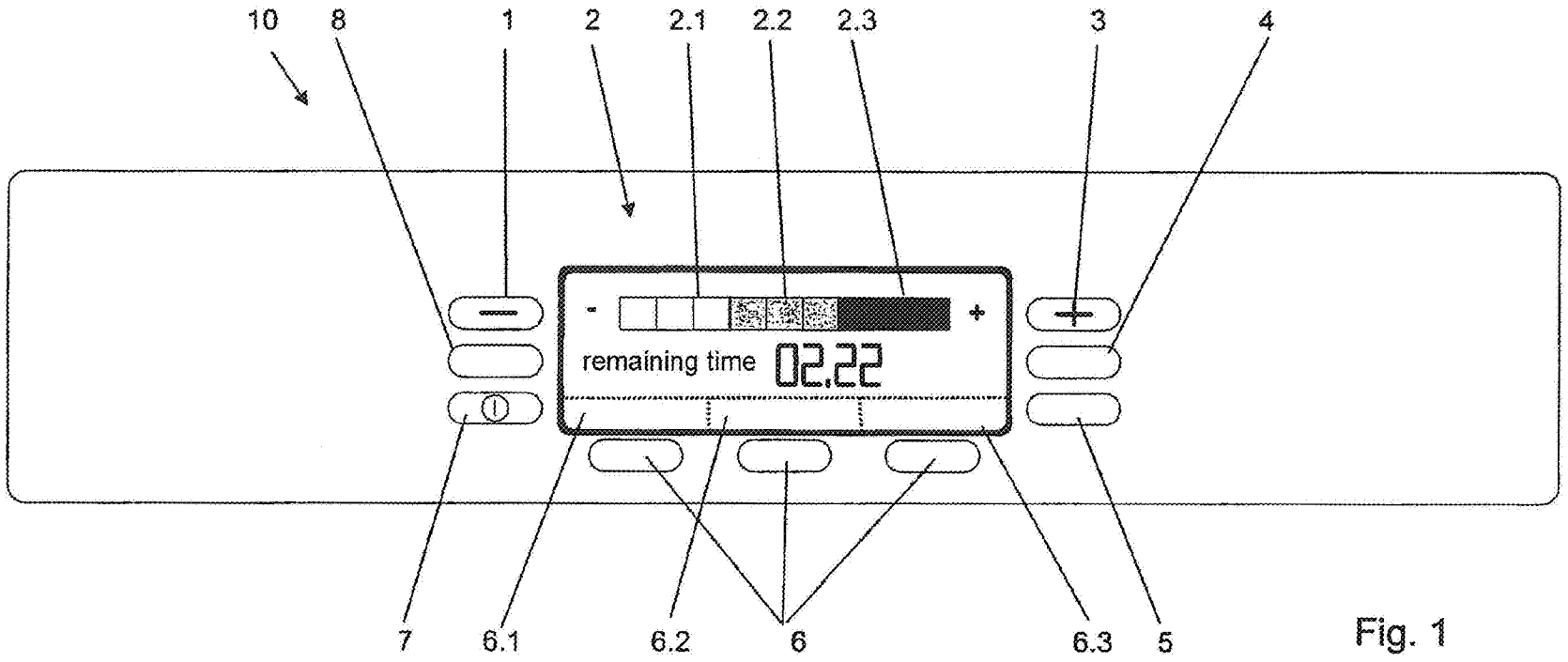
FIG. 1 is a view of a control panel for a dishwasher according to the present invention.

FIG. 1 shows a control panel 10 of a dishwasher. The control panel includes display means 2, preferably in the form of an LC display having different fields 2.1, 2.2 and 2.3 for displaying a selected soil level. The soil level can be selected using a minus button 1 and a plus button 3. Control panel 10 further contains a button 4 having a delay start function and a button 5 for starting the selected wash cycle. On the other side of display 2, there is provided a button 7 for activating and deactivating the dishwasher, and a button 8 which can be used to switch the display from the display mode to a textual display mode, in which additional information is displayed to the user.

Located underneath display 2 are three buttons 6 which allow selection of further cycle options for the selected wash cycle. Using these buttons 6, it is possible to select cycle options that affect, for example, energy consumption, noise emission, wash cycle duration, temperature, etc. Buttons 6 each have one display field 6.1, 6.2 or 6.3 associated therewith, so that the corresponding cycle options are presented to the user on display 2.

The dishwasher is further equipped with a turbidity sensor for measuring the soil level actually present.

To operate the dishwasher, the user may select a predetermined soil level using buttons 1 and 3 accordingly. Moreover, buttons 6 allow selection of additional cycle options.

During the execution of the wash cycle, the turbidity sensor detects whether the selected soil level corresponds approximately to the soil level actually present. If this is the case, the wash cycle continues in the selected manner. However, if deviations exist, the controller may directly influence the selection of the wash cycle and modify the same, for example, by adding an additional rinse step, increasing the temperature, increasing the wash cycle duration, changing spray pressure, etc. in order to adapt the dishwashing sequence to optimally match the soil level actually present.

Figure 2:
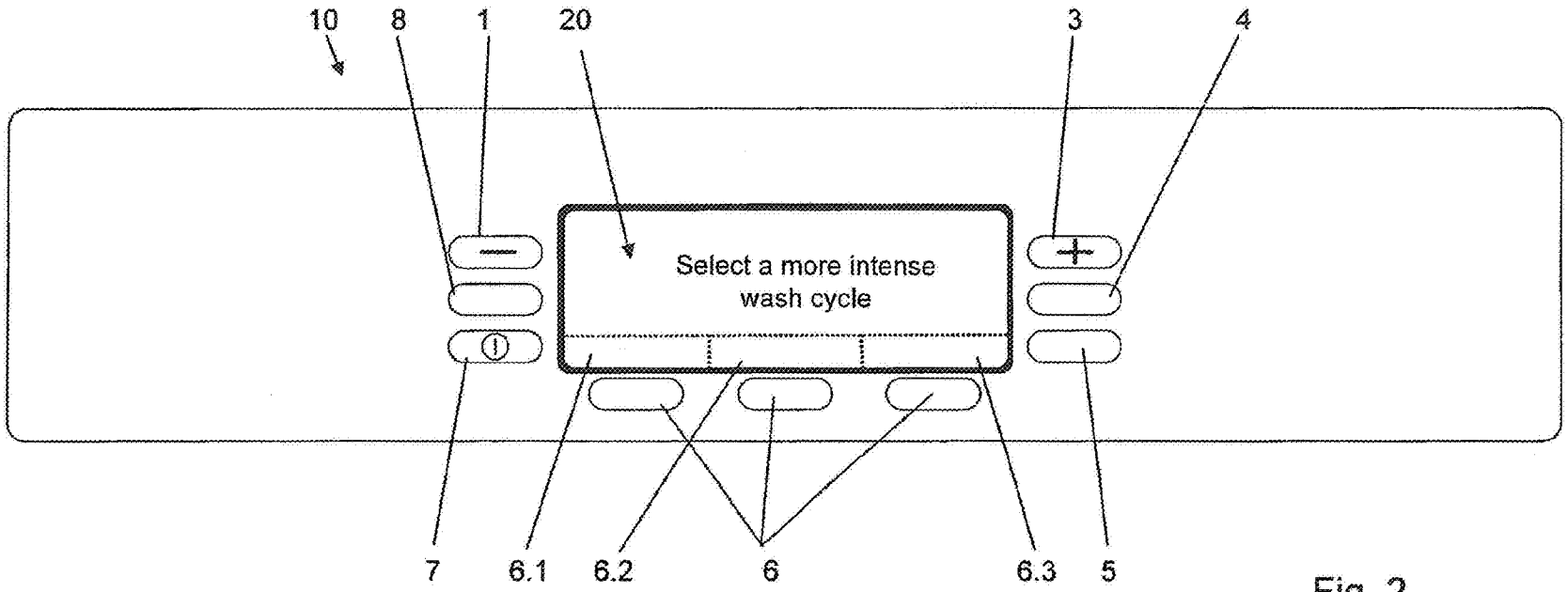
FIG. 2 is a view showing the control panel of FIG. 1 as it displays correction information.

If during the wash cycle, a deviation is detected between the selected soil level and the actual soil level, the controller may display correction information, as is illustrated in FIG. 2. Display 2 displays correction information 20, such as "Select a more intense wash cycle!" This information may be displayed either during the execution of the wash cycle, so that the user may influence the wash cycle. Alternatively, the information may be displayed upon completion of the wash cycle to enable the user to make a better selection next time. It is also possible to display correction information 20 only after the user has repeatedly made incorrect selections, thereby preventing the user from being informed of selection errors that result from a single mistake.

In the exemplary embodiment shown, the soil level can be selected directly during control of the dishwasher. However, the present invention can also be used in control systems, where it is only possible to select a wash cycle, but not to select a soil level.

While the invention has been described with reference to particular embodiments thereof, it will be understood by those having ordinary skill in the art that various changes may be made therein without departing from the scope and spirit of the invention. Further, the present invention is not limited to the embodiments described herein; reference should be made to the appended claims.

What is claimed is:

1. A dishwasher comprising;

an input element configured to select a first wash cycle from a plurality of wash cycles and configured to select a soil level;

a turbidity sensor configured to measure a soil level of a wash liquid;

a controller configured to control a cycle parameter and configured to perform a comparison as to whether an actual soil level substantially corresponds to the selected soil level; and a display device configured to display correction information if the actual soil level differs from the selected soil level.

2. The dishwasher as recited in claim 1, wherein the display device is configured to display the measured soil level in a plurality of gradations.

3. The dishwasher as recited claim 1, wherein the display device is configured to display an automatically selected wash cycle of the plurality of wash cycles, the automatically selected wash cycle being based on the measured soil level.

4. The dishwasher as recited in claim 1, wherein the display device is configured to display the correction information after a deviation between the actual soil level and the selected soil level has been detected a plurality of times.

5. The dishwasher as recited in claim 1, wherein the controller is configured to automatically modify at least one sub-cycle of the first wash cycle when the actual soil level differs from the selected soil level.

6. The dishwasher as recited in claim 1, wherein the cycle parameter includes at least one of a duration and temperature profile of a sub-cycle.

* * * * *